US007013994B2

(12) United States Patent
Eddison

(10) Patent No.: US 7,013,994 B2
(45) Date of Patent: Mar. 21, 2006

(54) DIRECTIONAL DRILLING APPARATUS

(75) Inventor: Alan Martyn Eddison, Scotland (GB)

(73) Assignee: Andergauge Limited, Aberdeen (GB)

( * ) Notice: Subject to any disclaimer, the term of this patent is extended or adjusted under 35 U.S.C. 154(b) by 217 days.

(21) Appl. No.: 10/470,031

(22) PCT Filed: Jan. 23, 2002

(86) PCT No.: PCT/GB02/00314

§ 371 (c)(1),
(2), (4) Date: Jul. 23, 2003

(87) PCT Pub. No.: WO02/059447

PCT Pub. Date: Aug. 1, 2002

(65) Prior Publication Data

US 2004/0079552 A1 Apr. 29, 2004

(30) Foreign Application Priority Data

Jan. 23, 2001 (GB) ..... 0101633

(51) Int. Cl.
*E21B 7/06* (2006.01)

(52) U.S. Cl. ..... 175/61; 175/73; 175/76

(58) Field of Classification Search ..... 175/61, 175/73, 76, 74, 75
See application file for complete search history.

(56) References Cited

U.S. PATENT DOCUMENTS

| | | | | |
|---|---|---|---|---|
| 2,919,897 A * | 1/1960 | Sims | 175/76 |
| 4,319,649 A * | 3/1982 | Jeter | 175/73 |
| 5,131,479 A * | 7/1992 | Boulet et al. | 175/73 |
| 5,311,953 A * | 5/1994 | Walker | 175/61 |
| 5,316,093 A * | 5/1994 | Morin et al. | 175/74 |
| 5,423,389 A * | 6/1995 | Warren et al. | 175/75 |
| 5,875,859 A | 3/1999 | Ikeda et al. | |
| 5,941,321 A | 8/1999 | Hughes | |
| 6,216,802 B1 * | 4/2001 | Sawyer | 175/73 |
| 6,321,857 B1 * | 11/2001 | Eddison | 175/61 |
| 6,808,027 B1 * | 10/2004 | McLoughlin et al. | 175/24 |

FOREIGN PATENT DOCUMENTS

| | | |
|---|---|---|
| EP | 0 467 335 | 1/1992 |
| EP | 0 577 845 | 1/1994 |

(Continued)

OTHER PUBLICATIONS

Copy of International Search Report for PCT/GB02/00314 completed May 15, 2002.

*Primary Examiner*—Hoang Dang
(74) *Attorney, Agent, or Firm*—Alston & Bird LLP

(57) ABSTRACT

Directional drilling apparatus for use in drilling a deviated bore comprises a mandrel for mounting to a drill string and having a main axis. A non-rotating mass is rotatably mounted on the mandrel and has a center-of-gravity spaced from the mandrel axis. The apparatus further comprises an offsetting arrangement including a non-rotating offsetting portion rotatably mounted on the mandrel, coupled to the mass, and having an outer profile defining an offset relative to the mandrel axis, and a bearing portion rotatably mounted on the offsetting portion. In use, the apparatus is run into an inclined bore on a string, and the offsetting portion is oriented relative to the mass. When the string is rotated the mass tends towards an orientation with its center-of-gravity positioned towards the low side of the bore and thus tends to maintain the offsetting portion in a desired relative orientation in the bore, the bearing portion rotationally isolating the offsetting portion from the bore wall.

44 Claims, 9 Drawing Sheets

FOREIGN PATENT DOCUMENTS

| | | | |
|---|---|---|---|
| GB | 2343470 | * | 5/2000 |
| WO | WO-97/47848 | | 12/1997 |
| WO | WO-01/04453 | | 1/2001 |
| WO | WO-01/51761 | | 7/2001 |

* cited by examiner

DATUM SET POSITION

RE-COCKED READY TO SET TOOLFACE

DIRECTIONAL DRILLING APPARATUS

FIELD OF THE INVENTION

The present invention relates to drilling apparatus, and in particular to directional drilling apparatus. Embodiments of the invention relate to directional drilling apparatus utilising an eccentric mass to maintain an offset in a drill string element, causing a drill bit to deviate in a desired direction. Other embodiments of the invention relate to directional drilling apparatus utilising the mass of the drill string, and items and tools mounted on the drill string, to maintain an offset.

BACKGROUND OF THE INVENTION

In directional or controlled trajectory drilling, the vertical inclination and azimuth of a drilled bore may be controlled such that the bore may extend from the surface to a target area which is not vertically aligned with the point on the surface where drilling commences. This permits a wide area to be accessed from a single drilling location and is therefore particularly useful in offshore drilling operations.

Conventionally, rotation of the drill bit mounted on the lower end of the drill string is achieved by rotation of the entire drill string, by a rotating turntable or "top drive" on the surface, and often also by a downhole motor located on the drill string adjacent the bit. The downhole motor is usually driven by the drilling fluid which is pumped through the string. Steerable downhole motors include a "bent" housing or elbow which introduces a small deviation (around 1°) in the end portion of the drill string. When the entire string is rotating such an elbow has little or no effect on the bore trajectory. However, if the string is stopped and then adjusted such that the motor bend is in a desired direction, rotating the drill bit using only the downhole motor will result in the trajectory of the well deviating. However, progress when drilling in this manner, without rotation of the drill string, tends to be relatively slow.

Various attempts have been made to provide drilling apparatus which will permit bore trajectory to be varied or controlled while still rotating the drill string, in some instances by providing a non-rotating eccentric mass on the drill string adjacent the drill bit. In some proposals, the mass engages the "low" portion of the bore wall and supports the drill string. A radially extending blade is mounted on the mass and engages the bore to produce a lateral force on the drill string causing the drill bit to deviate from its existing path, or at least prevents further deviation in the direction of the blade. However, the success of such apparatus has been limited as the mass provides an unstable support for the heavy drill string, such that the mass is likely to topple and be moved to one side by the string, which will tend to move downwards to occupy the lower part of the bore. Examples of such arrangements are illustrated in U.S. Pat. Nos. 4,638,873 and 4,220,213.

WO96\31679 describes a surface controlled well bore directional steering tool comprising a mandrel for forming part of the drill string, and two eccentric sleeves. The outer sleeve has an eccentric bore that forms a pregnant or weighted side. Two stabiliser shoes are provided on either side of the sleeve at 90° to the pregnant housing. The inner sleeve has a further eccentric longitudinal bore that contains the mandrel. The relative orientations of the sleeves may be controlled to move the mandrel to one side of the pregnant housing, thus transmitting a fulcrum force to the bit. An electric motor in the housing may be activated from surface to rotate the inner sleeve. As far as the present applicant is aware, this tool has not been commercialised, and it is believed that the tool would prove difficult to operate.

Applicant's GB 2,343,470 and U.S. patent application Ser. No. 09/435,453, and also WO97\47848 and U.S. patent application Ser. No. 09/202,342, the disclosures of which are incorporated herein by reference, describe arrangements including non-rotating offset masses provided in combination with pairs of stabilisers at either end of the mass, one of the stabilisers being adjustable relative to the mass to provide a desired offset of the drill string in the bore.

Other forms of directional drilling apparatus for controlling hole direction or inclination by providing eccentric or offset blades or members are described in U.S. Pat. Nos. 3,062,303, 3,092,188, 3,650,338, 3,825,081 and 4,305,474. U.S. Pat. No. 6,216,802 describes an arrangement for orienting a drilling assemble featuring two drive shafts coupled by a universal joint, with an orientation collar operable to change the orientation of one of the drive shafts.

It is among the objectives of the embodiments of the present invention to provide improved directional drilling apparatus utilising an offset or eccentric mass, or by offsetting the drill string itself.

SUMMARY OF THE INVENTION

According to one aspect of the present invention there is provided a directional drilling apparatus for use in drilling a deviated bore, the apparatus comprising:

a mandrel for mounting to a drill string and having a main axis;

a non-rotating mass rotatably mounted on the mandrel and having a centre-of-gravity spaced from the mandrel axis; and an offsetting arrangement including a non-rotating offsetting portion rotatably mounted on the mandrel and having an outer profile defining an offset relative to the mandrel axis, and a bearing portion rotatably mounted on the offsetting portion, the offsetting portion being coupled to the mass.

In use, with the apparatus located in a bore and the mandrel rotating, by locating or orienting the offset of the offsetting portion at a selected position, which location or orientation is maintained by the mass, the mandrel is offset in the bore, which offset may be utilised to urge a drill bit coupled to the mandrel in a desired direction.

The invention also relates to a directional drilling method utilising such an apparatus.

The provision of a bearing portion which is rotatably mounted on the offsetting portion serves to isolate the mandrel and offsetting portion from the bore wall, and thus facilitate operation of such directional drilling apparatus. In testing, apparatus in accordance with an embodiment of the invention has avoided many of the difficulties associated with prior proposals, and in particular the tendency of the offsetting portion and mass to rotate in the bore. In one test, an arrangement which had previously displayed a tendency to rotate the mass every 20 to 30 minutes, and thus disrupt the desired orientation, operated without difficulty when an offset stabiliser was provided with an appropriate bearing portion.

Although the particular mechanism which causes the rotation of the mass and offset stabilisers in prior proposals has not been unambiguously identified, it is believed that the presence of the bearing portion substantially prevents the transfer of torque from the rotating mandrel to an outer bearing surface of the bearing portion which may come into contact with the bore wall. In particular, although the mass and offsetting portion are rotatably mounted on the mandrel, typically through appropriate bearing arrangements, there will still be some transfer of torque to the mass and the offsetting portion. Thus, in prior arrangements absent a bearing portion, it is believed there is a tendency for the offsetting portion to "climb" around the bore wall. Thus, in certain situations this tendency, in combination with the moment arm created by offsetting the mandrel and attached drill string to one side of the bore, may result in rotation of the offsetting portion and mass in the bore, and loss of the desired effect. In practice, this may result in an apparatus featuring an offset mass operating effectively when it is desired to deviate in one direction, typically to the left, but not operating as effectively when the apparatus is utilised to turn a bore to the right, when friction and the above noted moment arm combine. Furthermore, with the present invention, any rotation of the bearing portion induced by other, external influences, such as contact with the bore wall, is isolated from the offset portion and mass.

Preferably, the apparatus is provided in combination with a drill bit.

Preferably, the non-rotating offsetting portion is coupled to the mass to permit variation of the relative angular orientation of the mass and offsetting portion, to achieve a desired deviation of the bit. This variation may be achieved by any appropriate means, examples of which are described in our GB 2,343,470 and WO97\47848. Most preferably, the relative angular orientation of the mass and offsetting portion is effected by rotation of one of the mass and offsetting portion relative to the other on the mandrel, and this relative rotation may be achieved by rotation of the mandrel. Preferably a selectively engageable gear arrangement is provided between the mandrel and the mass or offsetting portion. Most preferably the gear arrangement comprises a harmonic drive. This form of drive is very compact and allows for a relatively high reduction ratio: in one embodiment, the reduction ratio is 160:1, that is one complete relative rotation of the offsetting portion or the mass is achieved by rotating the mandrel, and the drill string to which the mandrel is coupled, 160 times. This facilitates accurate location of the offsetting portion without the provision of complex equipment, as an operator simply has to count the number of rotations of the drill string at surface to achieve a desired drilling direction. For example, in this embodiment 40 rotations of the drill string will move the offsetting portion and mass 90° relative to one another, and any minor errors in counting the number of rotations will have no significant effect on the resulting drilling direction. This gearing also allows transfer of significant torque to the mass or offsetting portion. Where the mass is capable of rotation relative to the offsetting portion, the maximum torque necessary to rotate the mass in the bore is known, such that the gear arrangement may be designed and built to deal with this torque.

The gear arrangement may be selectively engaged or disengaged in response to any appropriate condition or signal, including applied weight or tension, electrical or radio signals, and is most preferably responsive to fluid pressure. In a preferred embodiment, the mandrel is hollow to permit passage of drilling fluid, and the gear arrangement may be responsive to drilling fluid pressure. Most conveniently, relatively high fluid pressure, as experienced during the course of a drilling operation, serves to disengage the gear arrangement. Alternatively, or in addition, the gear arrangement may be arranged to be locked out while disengaged, to prevent inadvertent relative rotation of the mass or offsetting portion.

Preferably, the coupling between the offsetting portion and the mass provides for a datum set position, in which the relative positioning of the offsetting portion and the mass is known. This permits accurate relative location of the portion and mass without requiring complex sensors and transmitters, as the portion and the mass may be located in the datum set position and then moved relative to one another to a desired angular orientation. When provided in combination with a gear arrangement between the mandrel and one or both of the offsetting portion and the mass, it is preferred that the gear arrangement is adapted to disengage on the portion and mass reaching the datum set position. Furthermore, it is preferred that the gear arrangement may then be engaged to permit the angular orientation of the mass and offsetting portion to be set. In a preferred arrangement this is achieved by a pressure pulse achieved by, for example, turning drilling mud pumps on and then off.

Alternatively, or in addition, an orientation sensor may be provided for the offsetting portion, which sensor transmits signals to surface indicative of offsetting portion position. The signals may be transmitted directly to surface, or via another tool, such as a measurement while drilling (MWD) tool or a logging while drilling (LWD) tool; the MWD tool typically converts inputs to drilling fluid pulses, which may detected and interpreted at surface.

The non-rotating portion of the stabiliser may comprise a plurality of parts, and in one embodiment comprises inner and outer parts, each part defining an offset bore: by varying the relative orientation of the offset bores it is possible vary the offset of the mandrel relative to the outer circumference of the stabiliser. With such an arrangement it is possible to configure the stabiliser such that it does not create an offset, allowing a bore to be drilled straight ahead.

A relatively flexible string portion may be located adjacent said offsetting means. In certain circumstances, as described in GB 2,343,470, the provision of a relatively flexible string portion, such as a flex joint, in the string adjacent the offsetting means, facilitates accommodation of the deviation that may be introduced in the bore by operation of the offsetting means.

Preferably, the mass is selected to describe a smaller diameter than the bore. Thus, the mass is normally maintained clear of the bore wall, obviating any tendency for the heavy drill string to rest on the mass and topple to one side of the mass. Conveniently, the mass may be mounted between two larger diameter string elements, such as stabilisers, one of which comprises the offsetting arrangement, and both of which are preferably non-rotating. Most preferably, the offsetting arrangement is located between the mass and the drill bit, although in other embodiments the offsetting arrangement may alternatively be spaced from the bit by the mass, or may be spaced from the bit by a stabiliser which acts as a fulcrum. In the preferred arrangement, with the primary offsetting arrangement located between the mass and the drill bit, the other larger diameter string element at the opposite end of the mass may also provide an offset. The location or orientation of the offset may be variable or adjustable, however in the preferred arrangement the offset is arranged to locate the mandrel or drill string towards the low side of the bore, while still maintaining the mass clear of the bore wall. Such an offset makes little difference to the drilling direction but assists in maintaining the desired orientation of the primary offsetting arrangement by locating the mandrel and drill string to the low side of the bore. Indeed, in some instances such offsetting of the drill string may be sufficient to maintain a desired offset without requiring provision of an eccentric mass, which invention is the subject of another aspect of this invention.

Preferably, a rotating cutting arrangement, such as a rotating stabiliser provided with suitable cutting faces, or some other cutting arrangement, is provided adjacent the drill bit, and preferably between the first non-rotating element and the drill bit. When the drill bit is urged in a different direction by a change in relative orientation of the mass and offsetting portion, the bit may initially move predominately laterally, creating a ledge. If a non-rotating element, such as a non-rotating stabiliser, then encounters this ledge, the offsetting effect produced by the apparatus may be exaggerated, such that the drill bit creates a further ledge. Ultimately, this ledge formation process may result in the drilling apparatus being unable to proceed further. The provision of a rotating cutter adjacent the bit, which is slightly undergauge, for example by ⅛", and preferably of similar dimensions to the following non-rotating stabiliser, reams through the bore after the drill bit and removes any ledges formed by the bit, creating an opening through which the following non-rotating stabiliser may pass. This allows deviation of the bore at a controlled rate, typically 3°/100 feet.

According to another aspect of the present invention there is provided a directional drilling apparatus for use in drilling a deviated bore, the apparatus comprising:

a mandrel for mounting to a drill string and having a main axis;

a non-rotating mass rotatably mounted on the mandrel and having a centre-of-gravity spaced from the mandrel axis;

an offsetting arrangement including a non-rotating offsetting portion rotatably mounted on the mandrel and having an outer profile defining an offset relative to the mandrel axis;

means for selectively coupling the offsetting portion to the mass; and a gear arrangement for selectively coupling at least one of the mass or offsetting portion to the mandrel, whereby rotation of the mandrel is translatable to a lesser degree of rotation of one of the mass or offsetting portion.

According to a still further aspect of the present invention there is provided a directional drilling apparatus for use in drilling a deviated bore, the apparatus comprising:

a mandrel for mounting to a drill string and having a main axis;

a non-rotating mass rotatably mounted on the mandrel and having a centre-of-gravity spaced from the mandrel axis;

an offsetting arrangement including a non-rotating offsetting portion rotatably mounted on the mandrel and having an outer profile defining an offset relative to the mandrel axis, the offsetting portion being coupled to the mass; and a offsetting portion position sensor providing an offset position output signal.

According to a yet further aspect of the present invention there is provided a directional drilling apparatus for use in drilling a deviated bore, the apparatus comprising:

a mandrel for mounting to a drill string and having a main axis;

a drill bit coupled to a leading end of the mandrel;

a non-rotating mass rotatably mounted on the mandrel and having a centre-of-gravity spaced from the mandrel axis;

an offsetting arrangement including a non-rotating offsetting portion rotatably mounted on the mandrel and having an outer profile defining an offset relative to the mandrel axis, the offsetting portion being coupled to the mass; and a near-gauge rotating cutter located between the drill bit and a leading non-rotating element of the apparatus, whereby, in use, the cutter removes ledges created by changes in direction of the drill bit.

According to an alternative aspect of the present invention there is provided a directional drilling apparatus for use in drilling a deviated bore having a low side, the apparatus comprising:

a mandrel for mounting to a drill string and having a main axis;

a primary offsetting arrangement including a non-rotating offsetting portion rotatably mounted on the mandrel and having an outer profile defining an offset relative to the mandrel axis; and a secondary offsetting arrangement including a non-rotating portion coupled to the primary offsetting arrangement and arranged to offset the mandrel towards the low side of an inclined bore.

According to another aspect of the present invention there is provided a method of drilling a deviating bore, the method comprising the steps:

mounting a drill bit on a drill string and locating the string in a bore having a low side;

rotating the drill string such that the bit rotates;

providing a primary non-rotating offsetting arrangement towards the leading end of the string;

offsetting the leading end of the string in the bore such that the bit tends to advance in the direction of the offset;

providing a secondary non-rotating offsetting arrangement on a portion of the drill string following said leading end and coupled to said primary non-rotating offsetting arrangement; and offsetting said portion of the drill string towards the low side of the bore such that the mass of said portion of the string tends to maintain the offset of said leading end.

These two aspects of the present invention operate in a similar fashion to the previous aspects, however rather than maintaining the primary offsetting arrangement in a desired position by utilising a non-rotating mass, the mass of the drill string, and in particular the tendency for the drill string to want to lie towards the low side of the bore, is utilised to maintain the desired offset.

As used in relation to the latter aspect, the term drill string is intended to include, where appropriate, not only drill pipe and the like, but any mandrel forming part of the apparatus, and any items such as drill collars, subs and MWD tools mounted on or to the drill pipe.

Those of skill in the art will realise that many of the various preferred and alternative features described above with reference to the first aspect of the invention may also be provided, singly and in combination, in combination with the other aspects of the invention.

BRIEF DESCRIPTION OF THE DRAWINGS

These and other aspects of the present invention will now be described, by way of example, with reference to the accompanying drawings, in which:

FIG. 8*b* is a development of a part of the arrangement of FIG. 8*a.

DETAILED DESCRIPTION OF THE DRAWINGS

Figure 1:
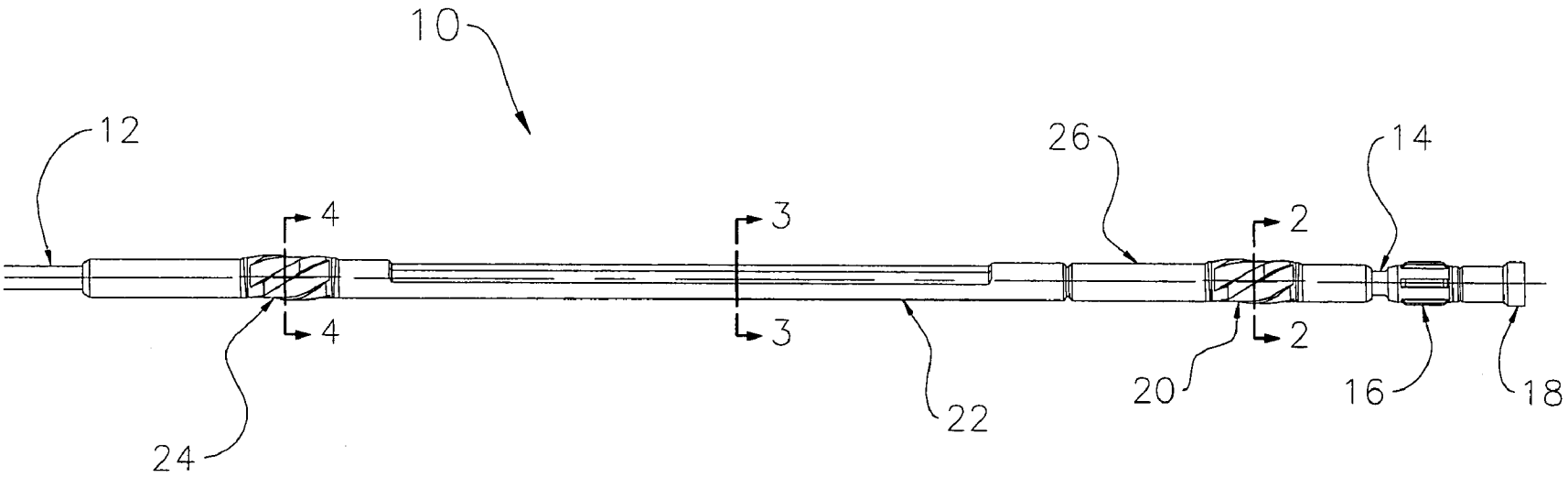
FIG. 1 is an elevation of directional drilling apparatus for use in drilling a deviated bore in accordance with an embodiment of the present invention.

Reference is first made to FIG. 1 of the drawings, which illustrates a directional drilling apparatus for use in drilling a deviated bore, in accordance with a preferred embodiment of the present invention. The apparatus 10 is mounted to the lower end of a drill string 12, formed of drill pipe sections, and includes a mandrel 14 having a following end coupled to the drill string 12 and a leading end coupled to a rotating stabiliser 16, with a drill bit 18 being mounted to the stabiliser 16. Rotatably mounted on the mandrel 14 are a primary offset stabiliser 20, an eccentric mass 22, and a secondary offset stabiliser 24. Accordingly, in use, during a drilling operation, the drill string 12 is rotated from surface, which in turn rotates the mandrel 14, stabiliser 16 and drill bit 18. However, the offset stabilisers 20, 24 and the mass 22 are intended to remain substantially stationary in the bore, other than to advance axially with the rest of the apparatus, that is the stabilisers 20, 24 and the mass 22 do not rotate.

Before describing the apparatus 10 in detail, the operation of the apparatus 10 will be briefly described. The apparatus 10 is utilised in directional drilling and permits the drill bit 18 to be directed to drill in a selected direction; to the side, upwards or downwards. This is achieved by arranging the primary offset stabiliser 20 to offset the mandrel 14, and thus the drill bit 18, in the bore towards the desired drilling direction. The desired offset or orientation of the stabiliser 20 is maintained by coupling the stabiliser 20 to the mass 22, which features a centre of gravity spaced from the mandrel axis, such that the mass 22 tends to lie towards the low side of the bore. This effect is enhanced by the provision of the secondary offset stabiliser 24, which offsets the mandrel 14 towards the low side of the bore, such that the weight of the mandrel 14, drill string 12, and any apparatus and tools mounted on the drill string 12, similarly contribute to maintaining the desired offset of the stabiliser 20.

The orientation of the offset provided by the stabiliser 20, and thus the drilling direction, may be varied by changing the relative orientation of the stabiliser 20 and the mass 22. This variation in orientation of the offset stabiliser 20 is achieved by means of a harmonic drive gear assembly 26 which may be configured such that rotation of the drill string 12 and mandrel 14 is translated to rotation of the stabiliser 20 relative to the mass 22.

Figure 2:
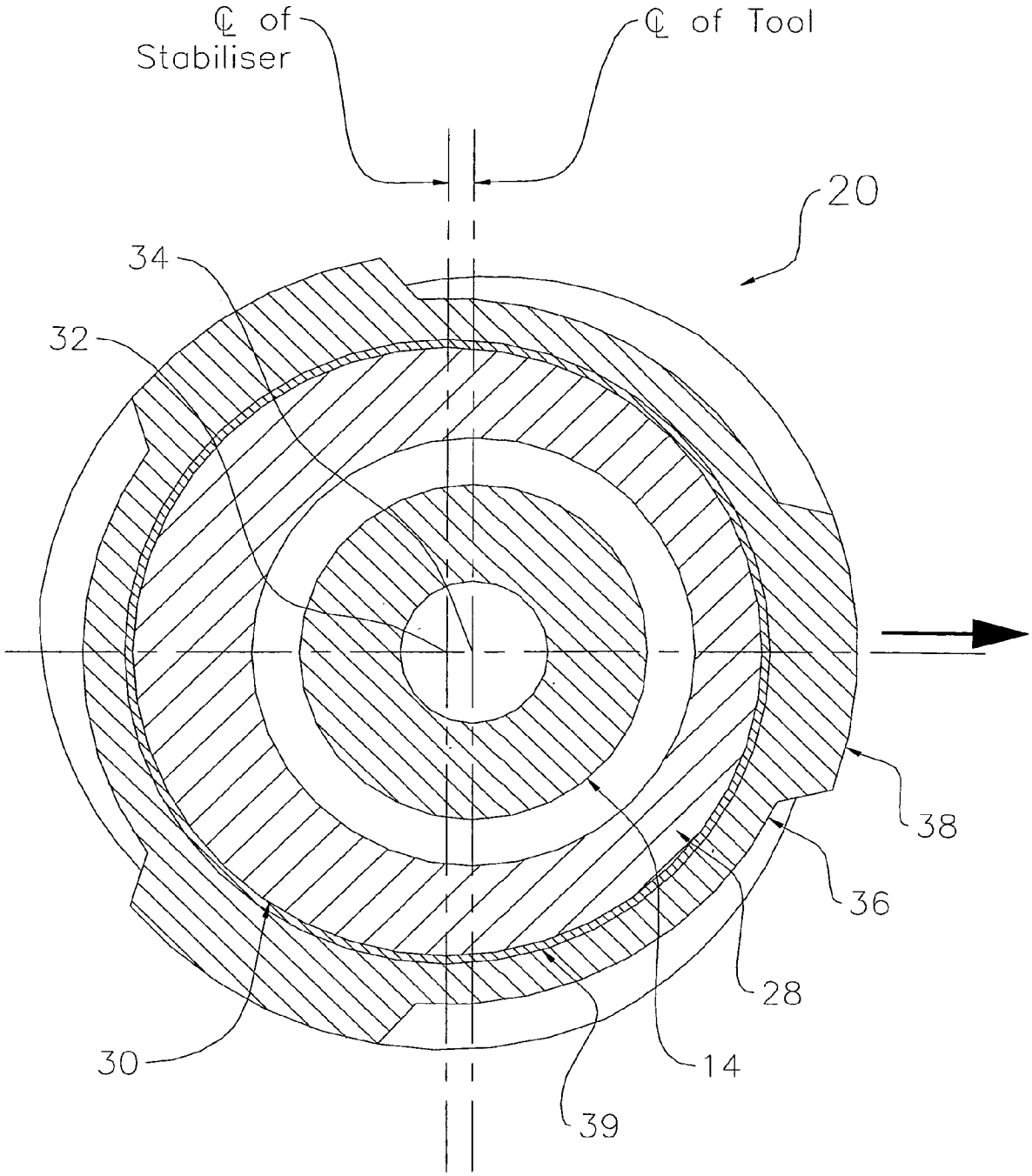
FIG. 2 is an enlarged sectional view on line 2—2 of FIG. 1.

Reference is now made to FIG. 2 of the drawings, which is an enlarged cross-sectional view of the primary offset stabiliser 20. It will be observed that the stabiliser 20 is mounted on the mandrel 14, and that the stabiliser 20 includes a non-rotating offsetting portion 28 having an outer profile 30 defining an offset relative to the mandrel axis, with the result that the stabiliser main axis or centre line 32 is spaced from the mandrel main access or centre line 34. A bearing portion 36, defining helical blades 38, is rotatably mounted on the offsetting portion 28, via needle roller bearing 39, and serves to isolate any torque transferred from the rotating mandrel 14 to the non-rotating offsetting portion 28 from the bore wall.

Figure 3:
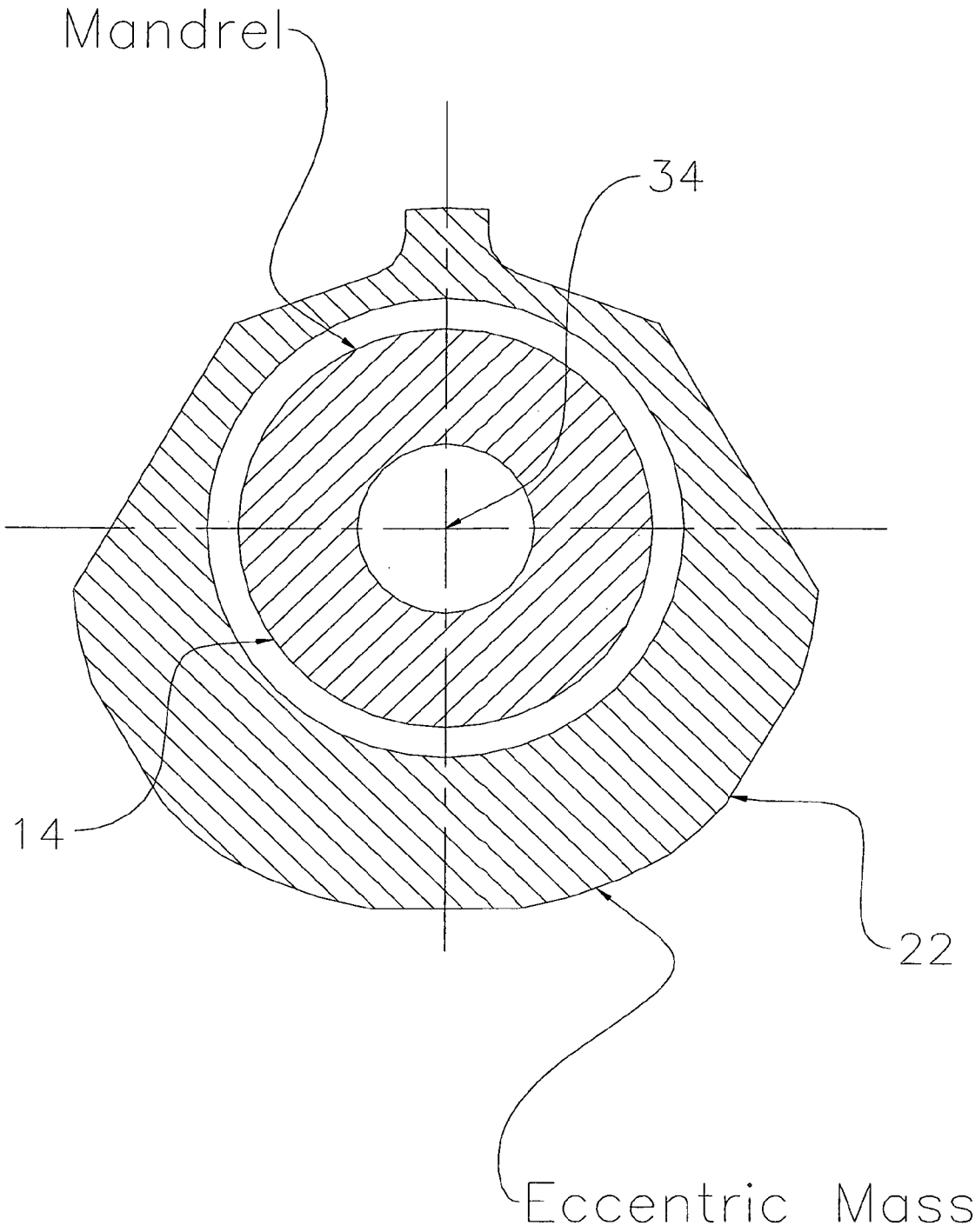
FIG. 3 is an enlarged sectional view on line 3—3 of FIG. 1.

Reference is now made to FIG. 3 of the drawings, which is a cross-section of the mass 22 and illustrates the configuration of the mass, which results in the centre of gravity of the mass being offset from the mandrel centre line 34, with the result that the mass 22 tends to lie in the configuration shown, that is with the "heavy" side of the mass 22 lying to the low side of the bore.

Figure 4:
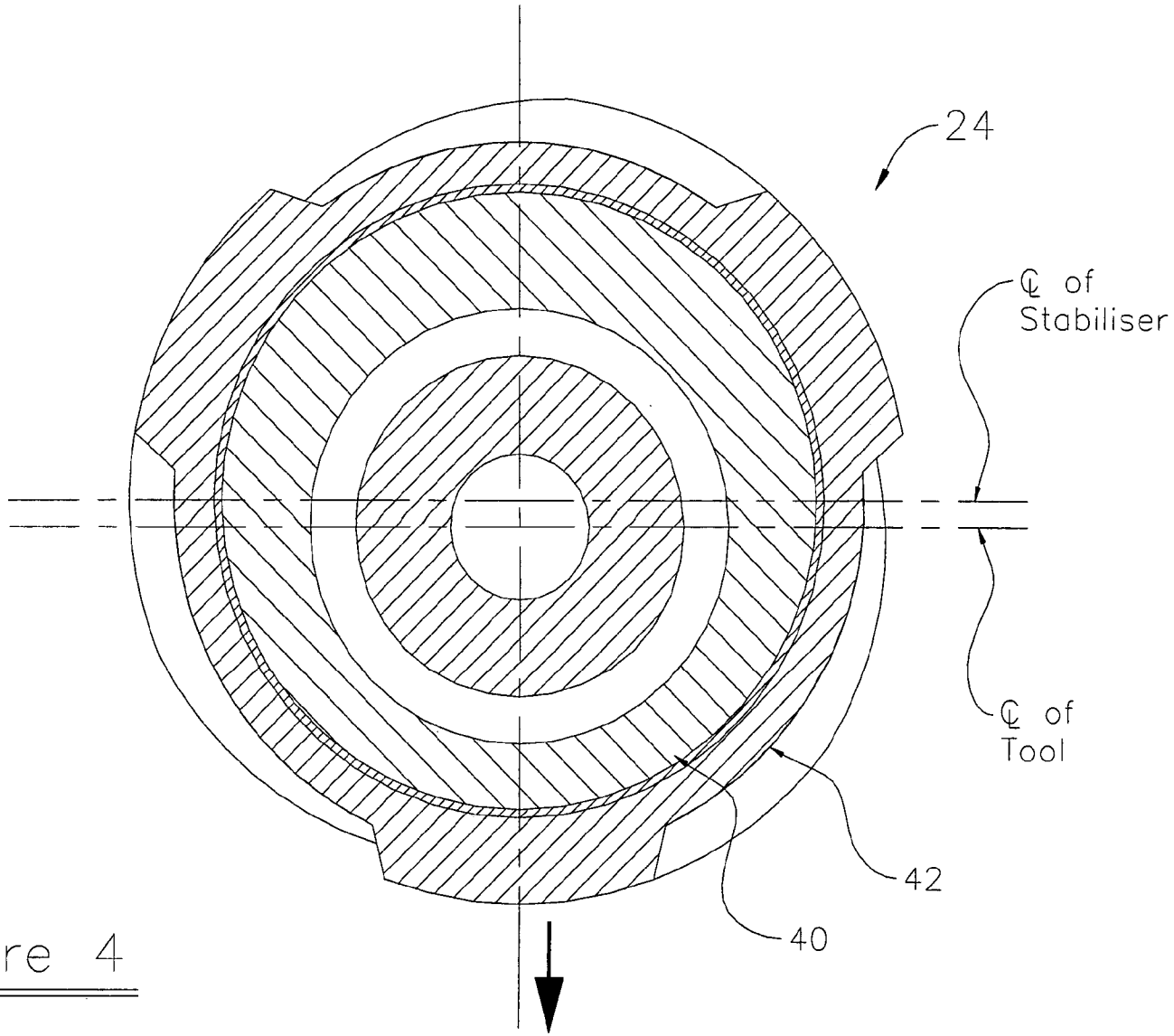
FIG. 4 is an enlarged sectional view on line 4—4 of FIG. 1.

Reference is now made to FIG. 4 of the drawings which is a cross-sectional view of the secondary offset stabiliser 24. It will be noted that the stabiliser 24 is of a substantially similar configuration of the stabiliser 20, having a non-rotating offsetting portion 40 and a bearing portion 42 rotatably mounted on the offsetting portion 40. However, in this embodiment the stabiliser provides a fixed (3/16") offset to the low side of the bore.

Reference will now be made to FIGS. 5 through 8 of the drawings, which illustrate the harmonic drive gear assembly 26 in greater detail. Reference is first made to FIG. 5*a* of the drawings, which illustrates the relative positioning of the elements of the gear assembly 26 during drilling, with the relative locations of the stabiliser 20 and mass 22 fixed and the mandrel 14 rotating freely relative to the stabiliser 20 and mass 22. The figure illustrates the mandrel 14 passing through the assembly 26, which includes sleeves 20*a,* 20*b* forming part of the. stabiliser 20, and a sleeve 22*a* which is coupled to the mass 22.

The gear assembly 26 of course includes the elements of the harmonic drive, including an inner drive gear ring 44 and outer driven gear cups 46, 48 which are rotatably coupled to the mass sleeve 22*a* and the stabiliser sleeve 20*b,* respectively. Located between the drive gear ring 44 and the outer driven gear cups 46, 48 is a toothed belt 50. The gear ring 44 includes a slight ovality and the outer driven gears cups 46, 48 have a different number of teeth, such that rotation of the drive ring 44, transferred via the belt 50, results in relative rotation of the outer driven cups 46, 48, and thus rotation of the mass 22 relative to the stabiliser 20. The driven ring 46 is coupled to the mass sleeve 22*a* by dog gears 52, while the driven ring 48 is coupled to the stabiliser sleeve 20*b* by a pin and slot arrangement 54.

Figures 5A, 5B:
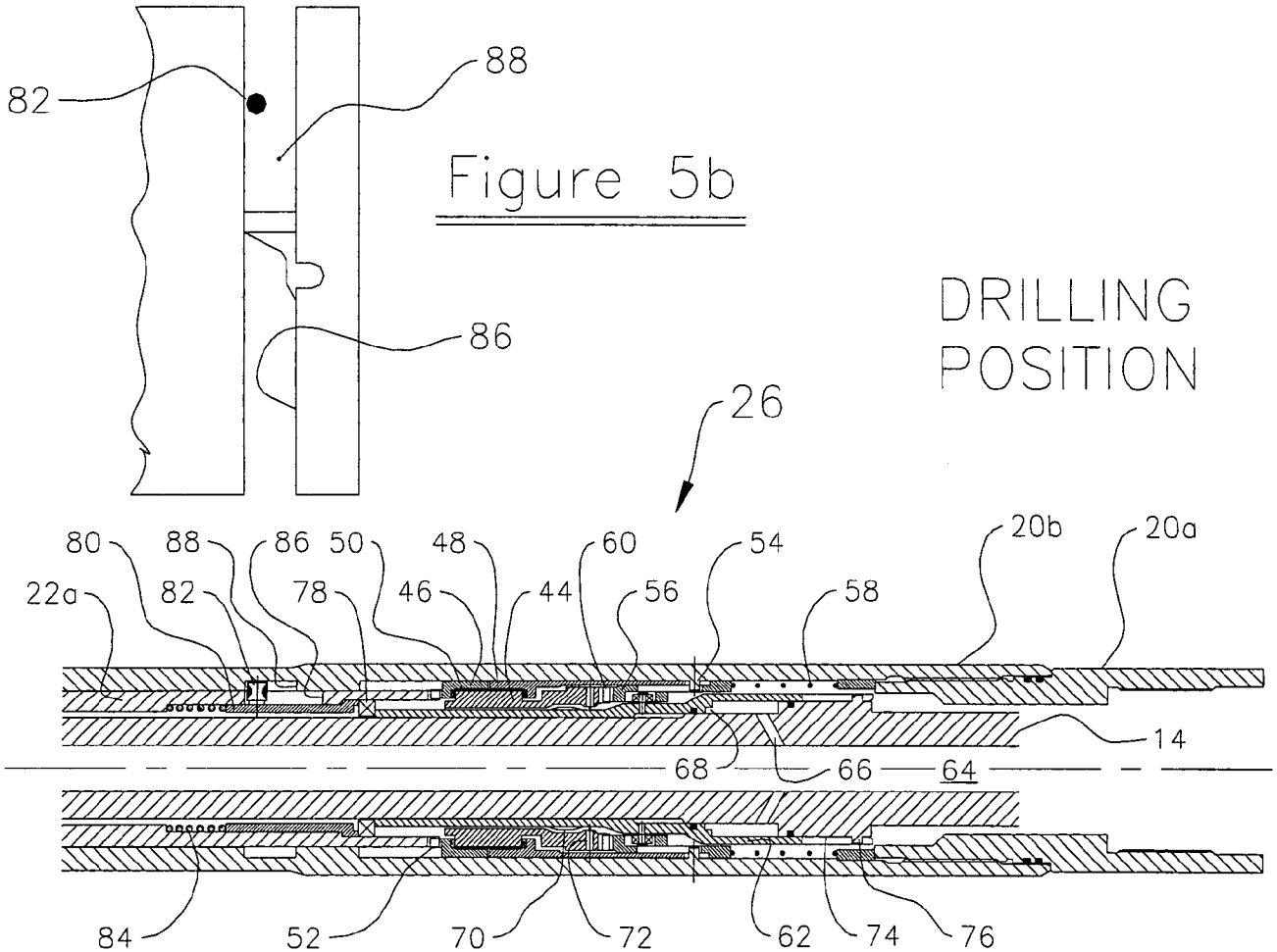
FIG. 5*a* is an enlarged sectional view of a gearing arrangement of the apparatus of FIG. 1, showing the gearing arrangement in a first configuration.
FIG. 5*b* is a development of a part of the arrangement of FIG. 5*a;*

In the configuration as illustrated in FIG. 5*a,* it is the intention that there should be no relative rotation between the stabiliser 20 and the mass 22, and the gear assembly therefore includes a gear locking mechanism comprising a locking sleeve 56 which is rotatably coupled to the stabiliser sleeve 20*b* and which is urged by a spring 58 to engage the drive ring 44 via dog gears 60.

Rotation of the mandrel 14 is transferred to the drive ring 44 via a pressure responsive sleeve 62 mounted on the mandrel 14. However, during a normal drilling operation, when the mandrel bore 64 is occupied by pressurised drilling fluid, fluid ports 66 in the mandrel wall communicate drilling fluid pressure to a piston 68 defined by the sleeve 62 and urges the sleeve 62 into a position in which circumferentially spaced teeth 70 provided on the sleeve 62 are spaced from radially extending sprung dogs 72 provided in the drive ring 44. The lower end of the sleeve 62 features axial slots 74 which co-operate with pins 76 formed on the mandrel 14, and which therefore allow transfer of rotation from the mandrel 14 to the sleeve 62. The upper end of the sleeves 62 abuts, via a bearing 78, a collar 80 on the mandrel which carries a sprung pin 82. The collar 80 is urged downwardly relative to the mass sleeve 22*a* by a spring 84, but during a drilling operation, and in the presence of pressurised drilling fluid in the mandrel bore 64, the sleeve 62 pushes the collar 80 upwardly against the spring 84. The sprung pin 82 mounted on the collar 80 extends radially through a channel 86 in the mass sleeve 22*a* and into a slot 88 in the stabiliser sleeve 20*b*.

Figures 6A, 6B:
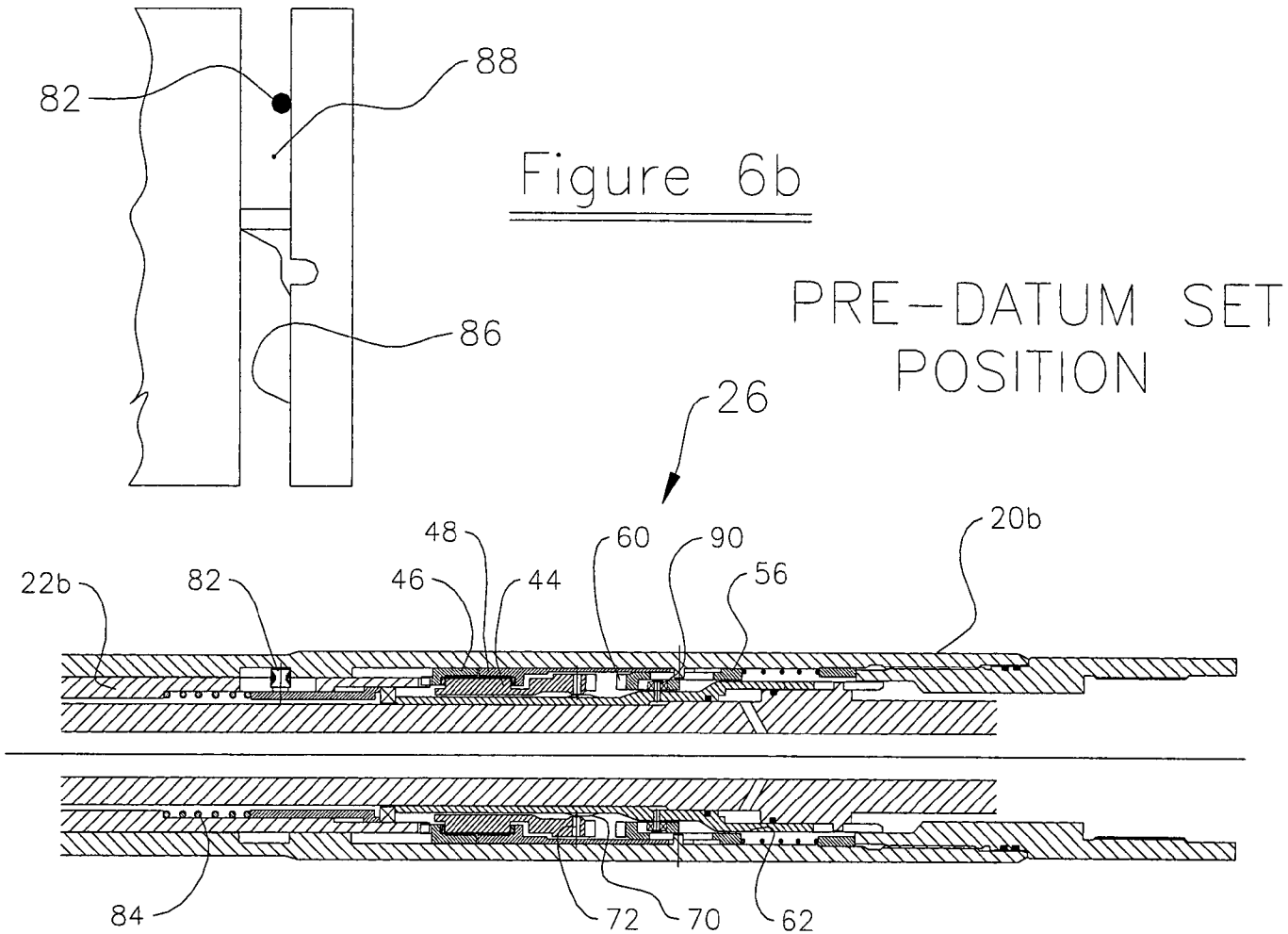
FIG. 6*a* is an enlarged sectional view of a gearing arrangement of the apparatus of FIG. 1, showing the gearing arrangement in a second configuration.
FIG. 6*b* is a development of a part of the arrangement of FIG. 6*a;*

Reference is now made to FIG. 6*a* of the drawings, which illustrates the configuration of the gear assembly 26 when the drilling fluid pumps have been shut down. In the absence of elevated drilling fluid pressure, the sleeve 62 is urged downwards by the spring 84 to locate the sleeve teeth 70 in engagement with the drive ring dogs 72. Further, a pin 90 extending radially from the sleeve 62 engages the gear locking sleeve 56, to disengage the dog gears 60. Furthermore, the sprung pin 82 moves to the lower side of the slot 88.

If the mandrel 14 is now rotated, the corresponding rotation of the sleeve 62 is transferred to the drive ring 44 and thus produces relative rotation of the mass sleeve 22*a* and the stabiliser sleeve 20*b*, such that the mass 22 will rotate relative to the stabiliser offsetting portion 28.

In the illustrated embodiment the number of teeth on the drive ring 44 and driven cups 46, 48 are selected such that one hundred and sixty rotations of the mandrel 14 will produce one complete (360°) rotation of the mass 22 relative to the stabiliser 20.

Figure 7B:
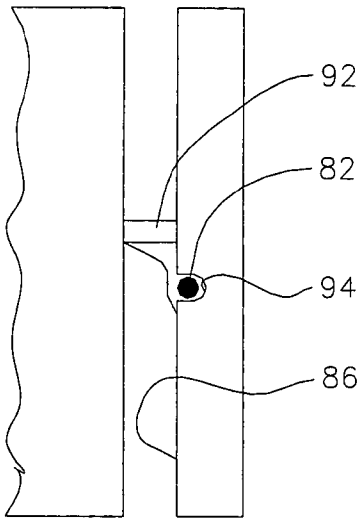
FIG. 7*b* is a development of a part of the arrangement of FIG. 7*a;*
Figure 7A:
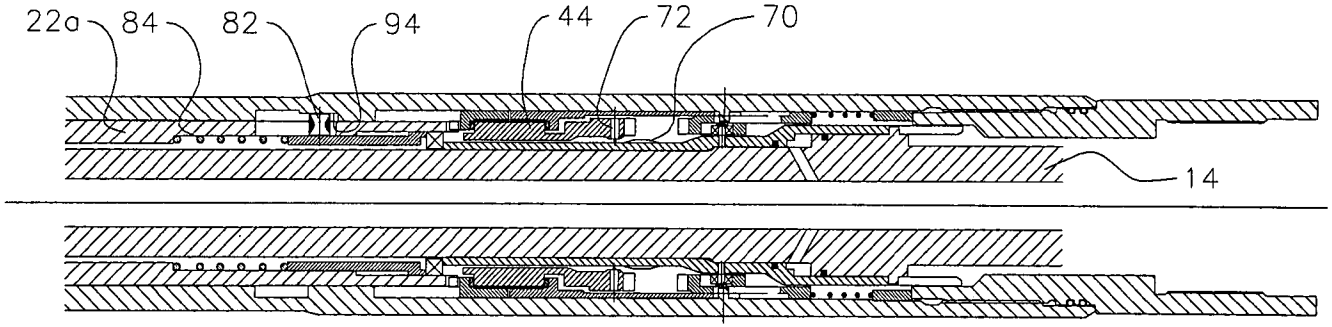
FIG. 7*a* is an enlarged sectional view of a gearing arrangement of the apparatus of FIG. 1, showing the gearing arrangement in a third configuration.

However, from the relative positioning of the sprung pin 82 in the channel 86 as illustrated in FIG. 6*b*, such relative rotation will only continue until the pin 82 moves to the datum set position illustrated in FIGS. 7*a* and 7*b* of the drawings, and as described below. As the mass 22 rotates relative to the stabiliser 20, the sprung pin 82 travels along the slot 88 until it encounters a ramp 92 which is profiled to move the pin radially inwardly and then downwardly into a notch 94 defined in the lower wall of the channel 86, under the influence of the spring 84. In this position the pin 82 rotationally locks the mass sleeve 22*a* relative to the stabiliser sleeve 20*b*.

Furthermore, the downward movement of the sleeve 62 brings the sleeve teeth 70 out of engagement with the drive ring dogs 72. Thus, on reaching the datum set position, rotation of the mandrel 14 is not transferred to the drive ring 44, and thus is not transferred to the mass 22 or stabiliser 20.

Reaching the datum set position may be identified on surface to provide an explicit indication to the operator that the stabiliser 20 is in a known predetermined orientation relative to the mass 22. However, simply by turning of the mud pumps and then rotating the drill string in excess of one hundred and sixty times, an operator may be assured that the datum set position has been achieved.

Figure 8B:
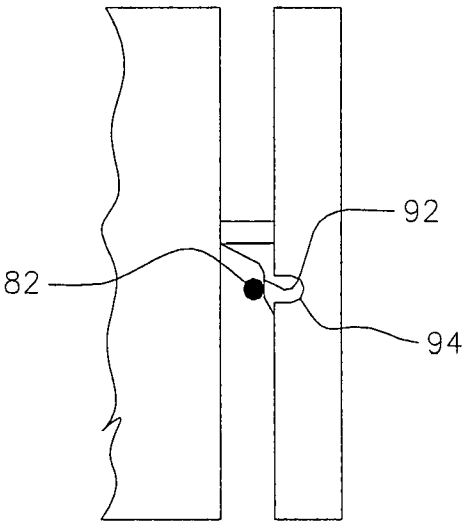
Figure 8A:
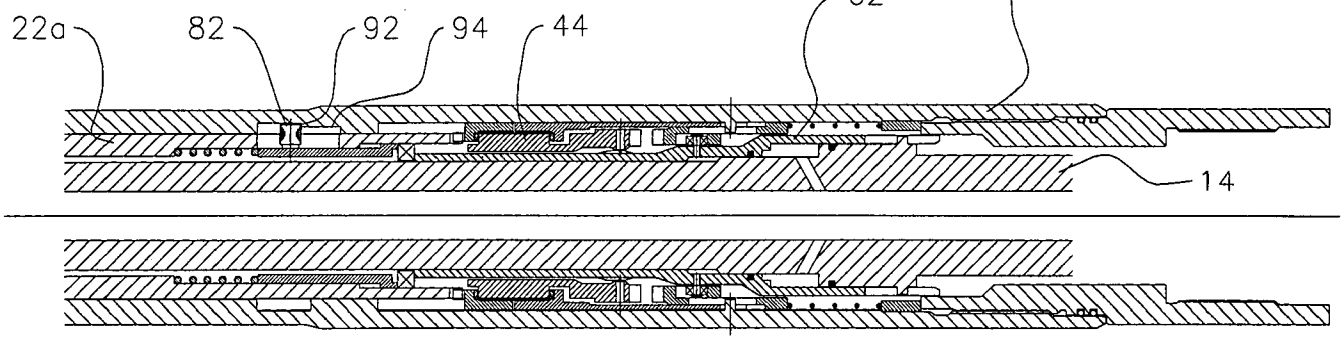
FIG. 8*a* is an enlarged sectional view of a gearing arrangement of the apparatus of FIG. 1, showing the gearing arrangement in a fourth configuration.

If the operator then turns the drilling fluid pumps on and then off again, the sleeve 62 will first be moved upwards, bringing the pin 82 out of the notch 94, the pin 82 then being prevented from re-entering the notch 94 on the pumps being shut down once more by engagement with an edge of the ramp 92, and this relative position is illustrated in FIG. 8*a* of the drawings. In this configuration the sleeve 62 is once more engaged with the drive ring 44, and the mass sleeve 22*a* is free to rotate relative to the stabiliser sleeve 20*b*, such that rotation of the mandrel 14 will be translated to rotation of the mass sleeve 22*a* and thus rotation of the mass 22. With the gear ratio as described above, forty rotations of the mandrel 14 will result in the mass 22 being rotated through 90° relative to the stabiliser 20.

Once the mass 22 and the stabiliser 20 are at the desired relative orientation, the drilling fluid pumps are then turned on once more and the sleeve 62 returns to the configuration as illustrated in FIG. 5*a*, in which the stabiliser 20 and mass 22 are fixed rotationally relative to one another.

Figure 9:
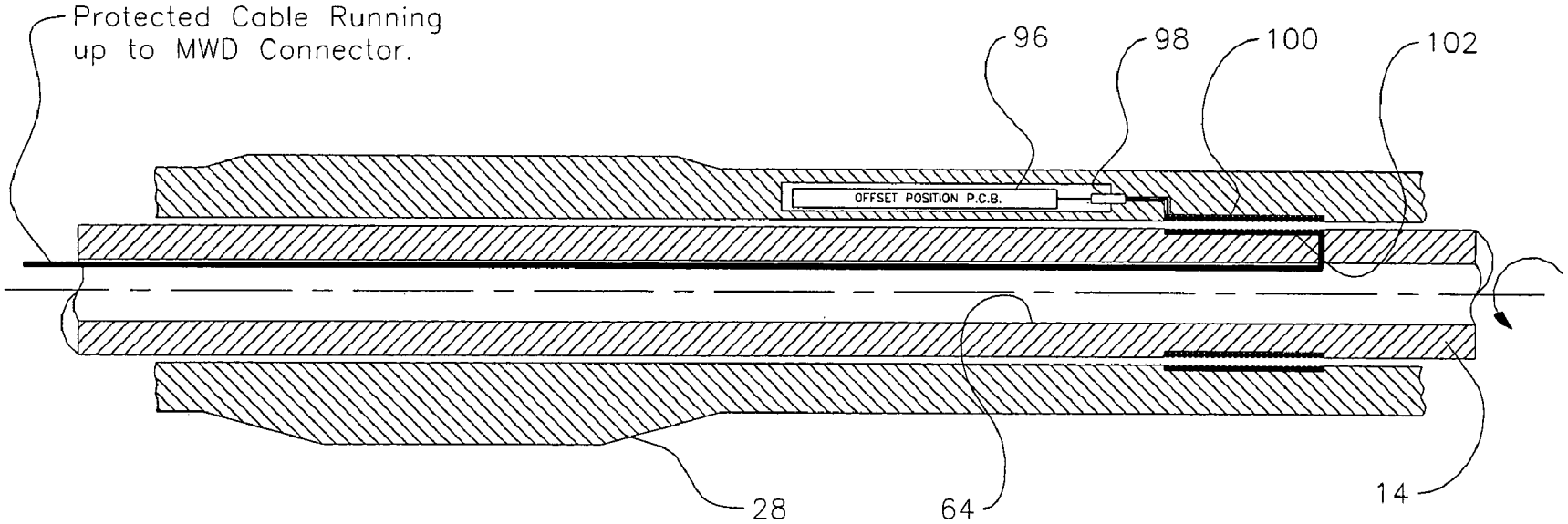
* and FIG. 9 is an enlarged sectional view of an offsetting arrangement of the apparatus of FIG. 1.

As noted above, the gear assembly 26 allows the operator to work from a datum set position to achieve a desired relative orientation between the mass 22 and the stabiliser 20 by rotating the mandrel 14 a known number of times. Further, the apparatus 10 includes a sensor which provides an indication of the position of the stabiliser offsetting portion 28 at any point, as will now be described with reference to FIG. 9 of the drawings. This figure illustrates the stabiliser offsetting portion 28, and located in an isolated chamber in the portion is a printed circuit board (PCB) 96 including appropriate orientation sensors. The output from the sensors is passed through a high pressure electrical connection 98 to a stationary coil 100 which is positioned around a rotating coil 102 provided on the mandrel 14. A protected cable 104 runs from the coil 102, through the mandrel bore 64, to an MWD connector stinger further up the drill string 12. As is well known to those of skill in the art, an MWD tool can translate a sensor input to pressure pulses in the drilling fluid, which may be detected at surface, and translated to provide an indication of stabiliser offset position.

In the event of a change in orientation of the mass 22 and offset stabiliser 22, the drill bit 18 is urged in the opposite lateral direction to the offset location. This may produce a ledge in the drilled bore as the bit 18 cuts laterally to accommodate the new offset. However, any such ledge is removed by the following rotating stabiliser 16; the stabiliser 16 is of similar external dimensions to the offset stabiliser 20 (typically ⅛" undergauge), and thus cuts a "hole" which will accommodate the stabiliser 20.

It will be apparent to those of skill in the art that the above-described apparatus 10 provides directional drilling apparatus which permits bore projectory to be varied and controlled while still rotating the drill string, and which allows changes in bore trajectory to be implemented in relatively straightforward manner from surface.

Those of skill in the art will also recognise that the apparatus 10 has been illustrated in somewhat simplified form, and that, in the interest of brevity, features such as pressure compensation pistons, as known to those of skill in the art, have not been illustrated or described.

It will further be apparent to those of skill in the art that the above-described embodiment is merely exemplary of the present invention, and that various modifications and improvements may be made thereto, without departing from the scope of the invention. For example, the above-described embodiments feature stabilisers having helical blades: other embodiments of the invention may feature straight or axial blades. Also, the above embodiments include stabiliser bearing portions mounted via needle roller bearings, and of course other bearing forms may be utilised, including other forms of roller bearings or plain bearings.

The invention claimed is:

1. Directional drilling apparatus for use in drilling a deviated bore, the apparatus comprising:

a mandrel for mounting to a drill string and having a main axis;

a non-rotating mass rotatably mounted on the mandrel and having a centre-of-gravity spaced from the mandrel axis; and an offsetting arrangement including a non-rotating offsetting portion rotatably mounted on the mandrel, coupled to the mass, and having an outer profile defining an offset relative to the mandrel axis, and a bearing portion rotatably mounted on the offsetting portion and being rotatable relative to the mandrel.

2. The apparatus of claim 1, wherein the bearing portion is mounted on the offsetting portion via a bearing.

3. The apparatus of claim 2, wherein the bearing portion is mounted on the offsetting portion via a roller bearing.

4. The apparatus of claim 1, wherein the bearing portion defines a plurality of blades.

5. The apparatus of claim 1, wherein the bearing portion is annular.

6. The apparatus of claim 1, in combination with a drill bit.

7. The apparatus of claim 1, wherein the non-rotating offsetting portion is coupled to the mass to permit variation of the relative angular orientation of the mass and offsetting portion.

8. The apparatus of claim 7, wherein the coupling between the non-rotating offsetting portion and the mass is arranged such that changes in the relative angular orientation of the mass and offsetting portion may be effected by rotation of one of the mass and offsetting portion relative to the other on the mandrel.

9. The apparatus of claim 8, wherein the coupling is arranged such that said relative rotation may be achieved by rotation of the mandrel.

10. The apparatus of claim 9, wherein a selectively engageable step-down gear arrangement is provided between the mandrel and one of the mass and offsetting portion.

11. The apparatus of claim 10, wherein the gear arrangement comprises a harmonic drive.

12. The apparatus of claim 10, wherein the gear arrangement is adapted to be selectively engaged and disengaged in response to a predetermined condition or signal.

13. The apparatus of claim 12, wherein the gear arrangement is responsive to fluid pressure.

14. The apparatus of claim 12, wherein the gear arrangement is responsive to relatively high fluid pressure, as experienced during the course of a drilling operation, to disengage the gear arrangement.

15. The apparatus of claim 10, wherein the gear arrangement is configured to be locked out while disengaged, to prevent inadvertent relative rotation of one of the mass and offsetting portion.

16. The apparatus of claim 7, wherein the coupling between the offsetting portion and the mass provides for a datum set position, in which the relative positioning of the offsetting portion and the mass is known.

17. The apparatus of claim 16, provided in combination with a gear arrangement between the mandrel and at least one of the offsetting portion and the mass, wherein the gear arrangement is adapted to disengage on the offsetting portion and mass reaching the datum set position.

18. The apparatus of claim 17, wherein the gear arrangement is adapted to be subsequently engageable to permit the angular orientation of the mass and offsetting portion to be set with reference to said datum set position.

19. The apparatus of claim 10, wherein the gear arrangement is adapted to subsequently engage in response to a pressure pulse.

20. The apparatus of claim 1, further comprising an orientation sensor for the offsetting portion, which sensor is adapted to transmit signals to surface indicative of offsetting portion position.

21. The apparatus of claim 1, wherein the mandrel is hollow to permit passage of drilling fluid therethrough.

22. The apparatus of claim 1, wherein the non-rotating offsetting portion comprises a plurality of parts.

23. The apparatus of claim 22, wherein the non-rotating offsetting portion comprises inner and outer parts, each part defining an offset bore, such that by varying the relative orientation of the offset bores it is possible vary the offset of the mandrel relative to the outer profile of the offsetting portion.

24. The apparatus of claim 23, wherein the non-rotating offsetting portion is configurable such that said portion does not create an offset, allowing a bore to be drilled straight ahead.

25. The apparatus of claim 1, wherein a relatively flexible string portion is located adjacent said offsetting arrangement.

26. The apparatus of claim 25, wherein said relatively flexible string portion is a flex joint.

27. The apparatus of claim 1, wherein the mass is selected to describe a smaller diameter than the bore to be drilled.

28. The apparatus of claim 27, wherein the mass is mounted between two larger diameter string elements.

29. The apparatus of claim 28, wherein the string elements are stabilisers.

30. The apparatus of claim 28, wherein one of the string elements comprises the offsetting arrangement.

31. The apparatus of claim 28, wherein both of the string elements are non-rotating.

32. The apparatus of claim 28, wherein the offsetting arrangement is adapted to be located between the mass and a drill bit.

33. The apparatus of claim 32, wherein a primary offsetting arrangement is adapted to be located between the mass and the drill bit, and the other larger diameter string element at the opposite end of the mass also provides an offset.

34. The apparatus of claim 33, wherein the offset provided by said other larger diameter string element is arranged to locate the mandrel and drill string towards the low side of the bore.

35. The apparatus of claim 1, wherein a rotating cutting arrangement is provided and is adapted for location adjacent a drill bit.

36. The apparatus of claim 35, wherein the rotating cutting arrangement is a rotating stabiliser provided with cutting faces.

37. The apparatus of claim 35, wherein the rotating cutting arrangement is adapted to be located between the first non-rotating element and the drill bit.

38. A directional drilling method for drilling a deviated bore, the method comprising the steps:

providing apparatus comprising a mandrel having a main axis, a non-rotating mass rotatably mounted on the mandrel and having a centre-of-gravity spaced from the mandrel axis, and an offsetting arrangement including a non-rotating offsetting portion rotatably mounted on the mandrel, coupled to the mass, and having an outer profile defining an offset relative to the mandrel axis, and a bearing portion rotatably mounted on the offsetting portion and being rotatable relative to the mandrel;

coupling one end of the mandrel to a drill string and another end of the mandrel to a drill bit;

running the apparatus into an inclined bore on the string, the bore having a low side;

orienting the offsetting portion relative to the mass; and rotating the string, whereby the mass tends towards an orientation with the centre-of-gravity positioned towards the low side of the bore and thus tends to maintain the offsetting portion in a desired relative orientation in the bore, the bearing portion rotationally isolating the offsetting portion from the bore wall.

39. Directional drilling apparatus for use in drilling a deviated bore having a low side, the apparatus comprising:

a mandrel for mounting to a drill string and having a main axis;

a primary offsetting arrangement including a non-rotating offsetting portion rotatably mounted on the mandrel for inducing an offset in the mandrel axis relative to the bore axis; and a secondary offsetting arrangement including a non-rotating portion coupled to the primary offsetting arrangement and arranged to offset the mandrel towards the low side of the bore.

40. A method of drilling a deviating bore, the method comprising the steps:

mounting a drill bit on a drill string and locating the string in a bore having a low side;

rotating the drill string such that the bit rotates;

providing a primary non-rotating offsetting arrangement towards the leading end of the string;

offsetting the leading end of the string in the bore such that the bit tends to advance in the direction of the offset;

providing a secondary non-rotating offsetting arrangement on a portion of the drill string following said leading end and coupled to said primary non-rotating offsetting arrangement; and offsetting said following portion of the drill string towards the low side of the bore such that the mass of said portion of the string tends to maintain the offset of said leading end.

41. Directional drilling apparatus for use in drilling a deviated bore, the apparatus comprising:

a mandrel for mounting to a drill string and having a main axis;

a non-rotating mass rotatably mounted on the mandrel and having a centre-of-gravity spaced from the mandrel axis;

an offsetting arrangement including a non-rotating offsetting portion rotatably mounted on the mandrel and having an outer profile defining an offset relative to the mandrel axis;

means for selectively coupling the offsetting portion to the mass; and a gear arrangement for selectively coupling at least one of the mass or offsetting portion to the mandrel, whereby rotation of the mandrel is translatable to a lesser degree of rotation of one of the mass or offsetting portion.

42. The apparatus of claim 41, wherein the gear arrangement comprises a harmonic drive.

43. Directional drilling apparatus for use in drilling a deviated bore, the apparatus comprising:

a mandrel for mounting to a drill string and having a main axis;

a drill bit coupled to a leading end of the mandrel;

a non-rotating mass rotatably mounted on the mandrel and having a centre-of-gravity spaced from the mandrel axis;

an offsetting arrangement including a non-rotating offsetting portion rotatably mounted on the mandrel and having an outer profile defining an offset relative to the mandrel axis, the offsetting portion being coupled to the mass; and a near-gauge rotating cutter located between the drill bit and a leading non-rotating element of the apparatus, whereby, in use, the cutter removes ledges created by changes in direction of the drill bit.

44. Directional drilling apparatus for use in drilling a deviated bore, the apparatus comprising:

a mandrel for mounting to a drill string and having a main axis;

a non-rotating mass rotatably mounted on the mandrel and having a centre-of-gravity spaced from the mandrel axis;

an offsetting arrangement including a non-rotating offsetting portion rotatably mounted on the mandrel and having an outer profile defining an offset relative to the mandrel axis, the offsetting portion being coupled to the mass; and an offsetting portion position sensor providing an offset position output signal while the offsetting portion remains rotatable relative to the mandrel.

* * * * *